US007779908B2

(12) United States Patent
Eriksson et al.

(10) Patent No.: US 7,779,908 B2
(45) Date of Patent: Aug. 24, 2010

(54) ARRANGEMENT FOR AFFIXING AN EXPANDABLE PACKER IN A HOLE

(75) Inventors: Jan Eriksson, Kista (SE); Sten-Åke Petersson, Stenhamra (SE)

(73) Assignee: Atlas Copco Craelius AB (SE)

( * ) Notice: Subject to any disclaimer, the term of this patent is extended or adjusted under 35 U.S.C. 154(b) by 217 days.

(21) Appl. No.: 11/571,760

(22) PCT Filed: Jul. 7, 2005

(86) PCT No.: PCT/SE2005/001132

§ 371 (c)(1),
(2), (4) Date: Jun. 17, 2008

(87) PCT Pub. No.: WO2006/006927

PCT Pub. Date: Jan. 19, 2006

(65) Prior Publication Data

US 2008/0302526 A1 Dec. 11, 2008

(30) Foreign Application Priority Data

Jul. 8, 2004 (SE) ..... 0401805

(51) Int. Cl.
*E21B 33/128* (2006.01)

(52) U.S. Cl. ..... 166/196; 166/187; 166/182

(58) Field of Classification Search ..... 166/182, 166/187, 196

See application file for complete search history.

(56) References Cited

U.S. PATENT DOCUMENTS 3,460,618 A * 8/1969 Blagg ..... 166/184

(Continued)

FOREIGN PATENT DOCUMENTS

EP 0566290 A1 10/1993

(Continued)

*Primary Examiner*—Shane Bomar
(74) *Attorney, Agent, or Firm*—Greenberg Traurig, LLP

(57) ABSTRACT

The present invention relates to an arrangement for affixing an expandable packer 22, 32 in a hole 30, wherein the arrangement includes a piston-and-cylinder device 11, 12 with which the piston can be caused to move in the cylinder with the aid of a pressurized medium. Expansion of the packer is effected with the aid of the movement of the piston 11, by transferring the force generated by piston movement to an expandable part 24, 34 of the packer 22, 32 so that said part will expand. Expansion of the packer results in the packer being firmly affixed in the hole by means of friction. The arrangement also includes an elongate main body 1 that has a through-penetrating aperture extending in the longitudinal direction of the body. The main body 1 has a front end 3, which faces inwardly of the hole when fastening the packer and towards the packer. The body includes a rear end 4 which carries means 9 for connection to a filler supply means, wherewith filler is delivered to the hole via the through-penetrating aperture 2 and via the packer 22, 32 subsequent to having affixed the packer in the hole. At least a part of the main body 1 is formed as a piston rod 16 on which and along which the piston 11 can move. The arrangement also includes pressure connection means 10 for connection to said pressurized medium, and a connection 19 between said pressure connection means and the piston 11.

13 Claims, 3 Drawing Sheets

U.S. PATENT DOCUMENTS

| | | | | |
|---|---|---|---|---|
| 4,403,660 | A * | 9/1983 | Coone | 166/387 |
| 5,339,894 | A * | 8/1994 | Stotler | 166/182 |
| 5,375,662 | A * | 12/1994 | Echols et al. | 166/386 |
| 5,586,601 | A | 12/1996 | Pringle | 166/212 |
| 5,718,288 | A * | 2/1998 | Bertet et al. | 166/287 |
| 6,192,982 | B1 * | 2/2001 | Divis et al. | 166/187 |
| 6,341,654 | B1 * | 1/2002 | Wilson et al. | 166/387 |
| 6,561,269 | B1 * | 5/2003 | Brown et al. | 166/77.1 |
| 6,752,205 | B2 * | 6/2004 | Kutac et al. | 166/187 |
| 6,779,601 | B2 * | 8/2004 | Wilson et al. | 166/187 |
| 6,854,522 | B2 * | 2/2005 | Brezinski et al. | 166/387 |
| 7,191,844 | B2 * | 3/2007 | Kenison et al. | 166/387 |
| 7,387,157 | B2 * | 6/2008 | Gambier et al. | 166/187 |
| 7,481,277 | B2 * | 1/2009 | Naquin et al. | 166/387 |
| 7,591,321 | B2 * | 9/2009 | Whitsitt et al. | 166/387 |

FOREIGN PATENT DOCUMENTS

| | | |
|---|---|---|
| WO | WO 0216729 A1 | 2/2002 |

* cited by examiner

ARRANGEMENT FOR AFFIXING AN EXPANDABLE PACKER IN A HOLE

TECHNICAL FIELD OF THE INVENTION

The present invention relates to an arrangement for affixing an expandable packer in a hole in a rock wall, preferably a pre-drilled hole. The arrangement includes a piston-cylinder device with which the piston can be caused to move in the cylinder with the aid of a pressurized medium, wherein expansion of the packer is effected with the aid of piston movement by virtue of transferring the force generated by said movement to an expandable part of the packer therewith causing the same to expand, wherewith expansion of the packer results in the packer being affixed in the hole by means of friction, as described in the preamble of claim 1.

BACKGROUND OF THE INVENTION

Work on and in rock walls often results in problems involving moisture and water that penetrates through cracks in the rock, which often requires the cracks to be sealed. Leakages also often occur in the vicinity of holes drilled with the intention of strengthening the rock wall, as a result of having punctured the natural existing rock screen. Sealing of the hole is often effected by injecting some type of sealant into the drilled holes. Examples of such sealants include cement grout or concrete injected into the hole. However, these sealants are unable to penetrate out into the actual cracks to any appreciable extent, wherewith the leakage problems remain in many instances. Another known rock sealing method requires coating the inside of the rock wall with concrete or some other appropriate material for instance.

It is not permitted in several cases to fasten reinforcing bolts in water-seeping holes, it being necessary to first ensure that the hole is dry.

A so-called packer is normally used for injecting a sealant or filler into a hole in a rock wall. A packer normally includes a tubular part that is fitted to the end of a tubular drill bit or to a conduit for delivering some type of sealant, and an expandable cuff, for instance made of rubber material, disposed on the tubular part of the packer. When this cuff is caused to expand the packer will be firmly affixed to the inside of the hole by means of friction, therewith tightening the packer against the walls of the hole. The sealant which is then injected into the hole is therefore unable to run out of the hole provided that the packer remains in the hole with the sealing medium still in a liquid state.

One known type of packer is expanded with the aid of the sealant later used to seal the hole. The sealant is advanced to the packer, where it is first conducted out to the surrounding cuff, causing the same to expand. When this has taken place, the pressure exerted by the sealant will cause a bursting disk or some corresponding device included in the packer to burst, so that the sealant is able to penetrate past the packer and out into the rearward lying hole. The packer is normally left in the hole upon completion of the injection phase and when the sealant has hardened since the packer is usable only once and can not therefore be re-used. Consequently, this type of packer is expensive, since it is designed for one-time-use only.

Another known type of packer is expanded with the aid of a pneumatic or hydraulic pressure medium. This requires the application of a separate tool to the packer at the hole opening. The disadvantage of this type of packer is that it can only be used in the close vicinity of the hole opening, since the tool is relatively unwieldy and space-demanding. Because the packer cannot be inserted further into the hole, there is a risk that sealant can not be forced right down to the bottom of the hole and out into those cracks situated at the hole bottom. This may well result in an empty space behind the filling material, with the risk of this space being filled with water. This water will then exert a pressure on the injected filling material, which normally shrinks slightly after hardening and which will not therefore adhere fully to the hole walls, which can result in the entire "plug" of filler material releasing its grip on the hole as a result of water leakage, and sometimes even falling out of the hole.

SUMMARY OF THE INVENTION

The aim of the present invention is to provide an arrangement which solves the aforesaid problems and satisfies existing needs. This aim is achieved with an arrangement that has the novel features set forth in the characterizing clause of the accompanying claim 1.

Thus, the inventive arrangement is characterized in that it includes an elongate main body that has a longitudinally through-penetrating aperture that also has a front end which faces inwardly in the hole when affixing the packer and faces towards the packer, a rear end that faces outwardly from the hole, wherein at least a part of the main body has the form of a piston rod externally of which and along which the piston is movable, and wherein the arrangement includes means for connection to a pressurized medium source and a connection between the pressure medium connection means and said piston.

One benefit afforded by the novel arrangement is that it can be made very flexible and compact. Moreover, there can be used a pneumatic or an hydraulic pressure medium to expand the packer, which opens the possibility of re-using the packer since it will not be harmed by filler that hardens in the packer cuff. Primarily because the main body containing the through penetrating aperture for filler is used as a piston rod with the piston moving along the outside of the piston rod, there is obtained the benefit of achieving a construction which is so compact and so small as to enable it to be inserted fully into the hole in the rock. This opens further possibilities. Among other things, the packer can be inserted right down to the bottom of the hole therewith enabling sealing to be achieved at the hole bottom and preventing an empty space being left behind the filler, such a space leading to the problems described above.

According to one beneficial feature of the inventive arrangement, said arrangement includes means for connection to a filler supply device for delivering filler to the hole after affixing the packer, via the through-penetrating aperture and via the packer. Although this renders the invention particularly suited for the contemplated field of use, it does not in itself constitute the assumption that the arrangement shall be capable of functioning as a packer fixing means.

According to another beneficial feature, the inventive arrangement is designed as a separate unit, which can be released from the packer when delivery of filler to the hole has been terminated. This is beneficial, since the arrangement can be used with packers of the type intended for one-time-use only. The arrangement is released from the packer when the supply of filler is completed and the packer is thus left in the hole.

According to a further beneficial feature of the invention, the cylinder includes a separate part, which is mounted at least partially on the main body. This provides advantages from a manufacturing aspect.

The piston may also be provided with a return spring to facilitate and to ensure return of the piston to its starting position when it is no longer influenced by the pressurized medium.

Another beneficial feature of the inventive arrangement is that it has maximum measurements which enable it to be inserted totally in said hole. As earlier mentioned, this provides the advantage of enabling the packer to be affixed in the hole along its full length or at least far into a hole. Another benefit thus afforded is that filler can be delivered batch wise into the hole with the aid of a re-usable packer. When the first batch of filler has been delivered, the packer is caused to return to its non-expanded state and can thus be moved together with the arrangement further out of the hole and then re-affixed to the sides of the hole and a further batch of filler can be delivered to the hole. This enables very deep holes to be filled and sealed.

According to a first embodiment of the invention, the front end of the main body includes means for connection to the packer, for instance in the form of a threaded part that projects out around the aperture. The thread on said part is preferably a left hand thread so that the arrangement can be unscrewed from the packer, even completely, without changing thread connections. This can apply, for instance, when the arrangement sits on the end of a drill casing when it is, of course, undesirable to unscrew individual elements of the drill casing.

Alternatively the means on the main body for connection to the packer may comprise a bayonet coupling arranged as an outwardly projecting part around the aperture.

According to the same first embodiment, the rear end of the arrangement may be threaded for connection to a drill casing. Alternatively, it may be adapted for the attachment of a high-pressure hose through which filler is delivered. Threads may be suitable as connection means also in this case.

According to a second embodiment the arrangement is designed for attachment to the outside of an extension of an inner tubular part of the packer, this tubular part being used to deliver filler with the extension accommodated in side the through-penetrating aperture in the main body. It may also be designed so that said extension of an inner tubular part of the packer is able to rotate in the through-penetrating aperture. This provides the advantages of enabling drilling to be carried out with the entire inventive arrangement fitted to a tubular part of the packer which, in turn, is connected to the remainder of the drilling equipment.

The arrangement is suitable for use in affixing packers in all conceivable operations in which packers are used, and is independent of the type of filler and sealant used, for instance cement and concrete. The filler can be delivered conventionally or can be injected under high pressure.

BRIEF DESCRIPTION OF THE DRAWINGS

The present invention will now be described in more detail with reference to the exemplifying embodiments illustrated in the accompanying diagrammatic drawings, in which.

Those illustrated components that are common to the various embodiments have been identified by the same reference signs.

DETAILED DESCRIPTION OF THE INVENTION

Figure 1:
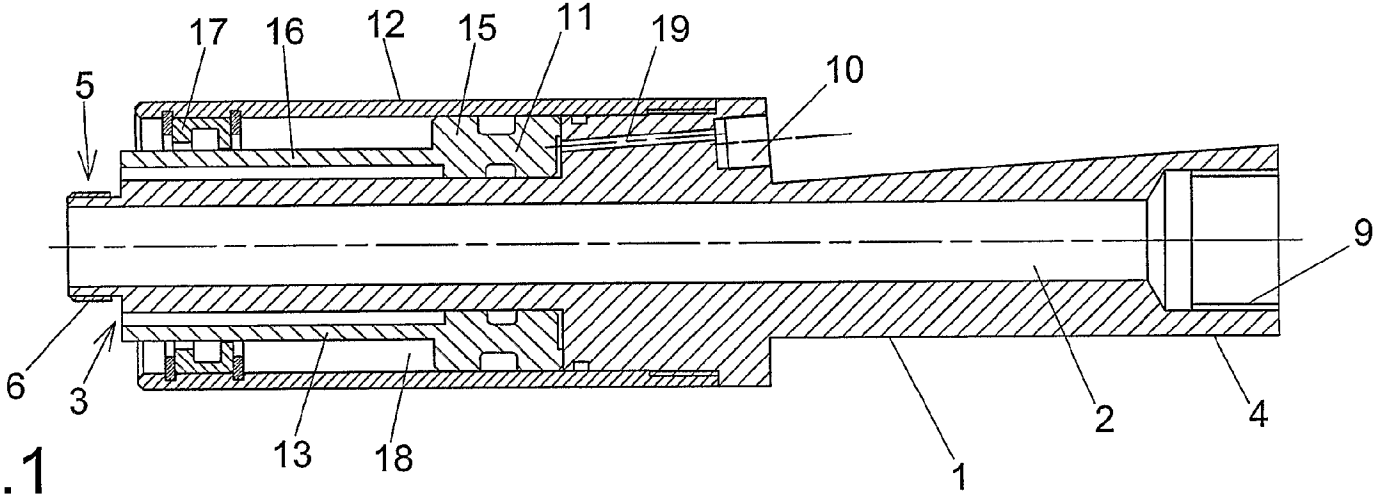
FIG. 1 is a diagrammatic sectioned side view of a first embodiment of an arrangement according to the present invention.

FIG. 1 illustrates an embodiment of an inventive arrangement based on a piston-cylinder device 11, 12. The arrangement includes an elongate so-called main body 1 having a through-penetrating aperture 2. The main body has a front end 3, which faces in towards the hole when the arrangement is used to affix a packer in a hole, and an opposite rear end 4. The front end 3 includes a part 5 which projects out around the aperture 2 and which carries means 6 for connecting the arrangement to a packer. These connecting means may, for instance, comprise an external thread or some other typical type of coupling, such as a bayonet coupling. The choice of connecting means is influenced by the configuration or appearance of the packer, which it is planned to use and is conveniently adapted to a commercially available existing packer. If possible, there is used a left-hand thread, which enables the arrangement to be readily loosened from the packer if so desired, without other normally screwed parts in the system being loosened from one another.

The rear end 4 of the main body 1 carries means for connection to a supply means for some type of filler or sealant. In the illustrated embodiment, these means are comprised of a threaded portion around the aperture 2 and to which the end of a drill casing can be connected or a screw joint on a high pressure hose. Filler can be pumped to the arrangement and to the packer through the drill casing or the high pressure hose and then further out into the hole.

The main body 1 also includes pressure connection means 10 for connection to a pressure medium source. These means includes typical means for connecting either an hydraulic hose or a compressed air hose, depending on whether the pressure medium intended for use to move the piston 11 is an hydraulic fluid or a pneumatic fluid in the form of compressed air.

The main body 1 has at its front end a narrower part which functions as a piston rod 13 for the piston 11. Also mounted on the main body 1 is a sleeve-like part 12 which forms the cylinder 12 of the piston-cylinder device 11, 12. The piston 11 is movable in the space between the cylinder 12 and the piston rod 13. The rear part 15 of the piston is in direct sealing abutment with the inside of the cylinder and the outside of the piston rod. The front part 16 of the piston is significantly thinner in section and a piston guide 17 that includes a seal is disposed between the piston and the front part of the cylinder. In other respects, the front end of the space 18 between the cylinder and the piston rod facing inwardly of the hole is open so as to enable the front part 16 of the piston to move out of the cylinder and actuate the expandable part of a packer when pressure medium is allowed to act on the rear side of the piston. As the piston moves forward, the piston guide 17 will act to stop movement of the piston and therewith limit its length of stroke, as a result of the rear part 15 of the piston coming into contact with said guide. The rear part of the space 18 includes a channel 19 provided in the main body and connecting said space to the pressure connection means 10 and thus also to the source of pressure medium.

Figure 2:
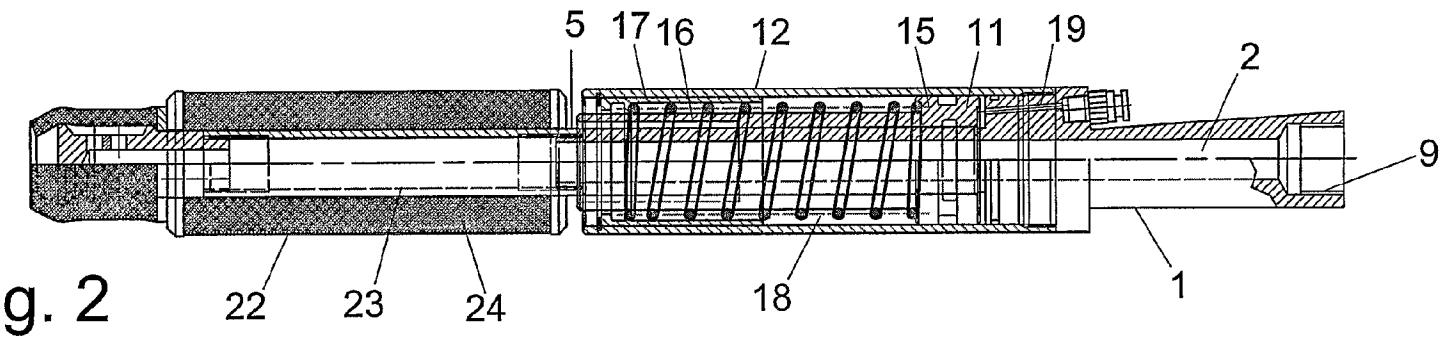
FIG. 2 is a diagrammatic sectioned side view of an alternative embodiment of an arrangement according to the invention fitted to a packer.

FIG. 2 illustrates a variant of the arrangement shown in FIG. 1 and includes corresponding components, with the addition of a spring 20 disposed around the front thinner part 16 of the piston. The spring lies against a front surface of the rear part 15 of the piston and against the rear side of the piston guide 17. This spring functions as a return spring as will be explained hereinafter. FIG. 2 also shows a packer 22 to which the arrangement is coupled in a manner corresponding to that described below with reference to FIGS. 3 and 4.

Figure 3:
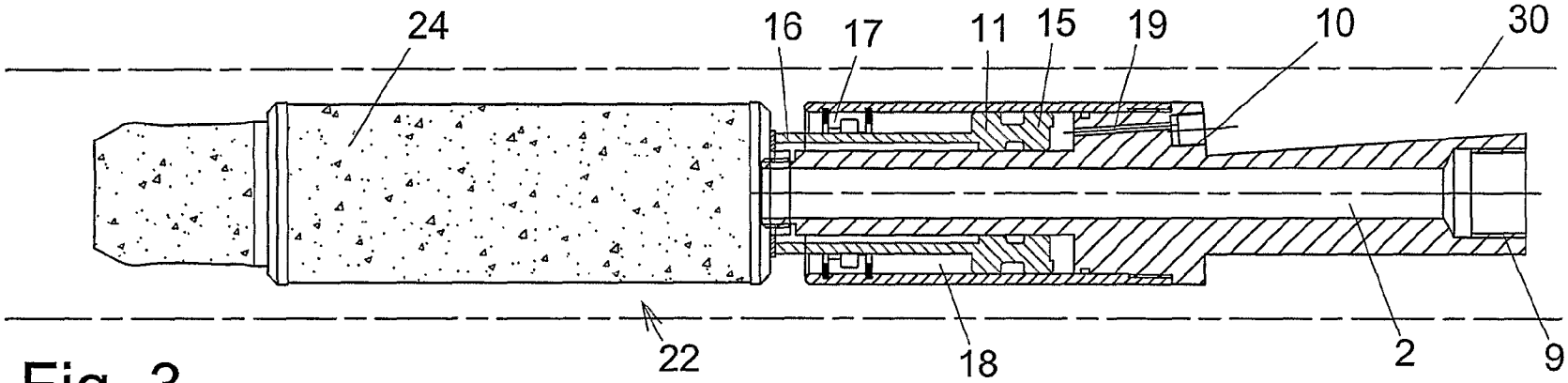
FIG. 3 is a diagrammatic sectioned side view of the first embodiment of an arrangement according to the invention fitted to a packer and shows the packer in a non-expanded state.
Figure 4:
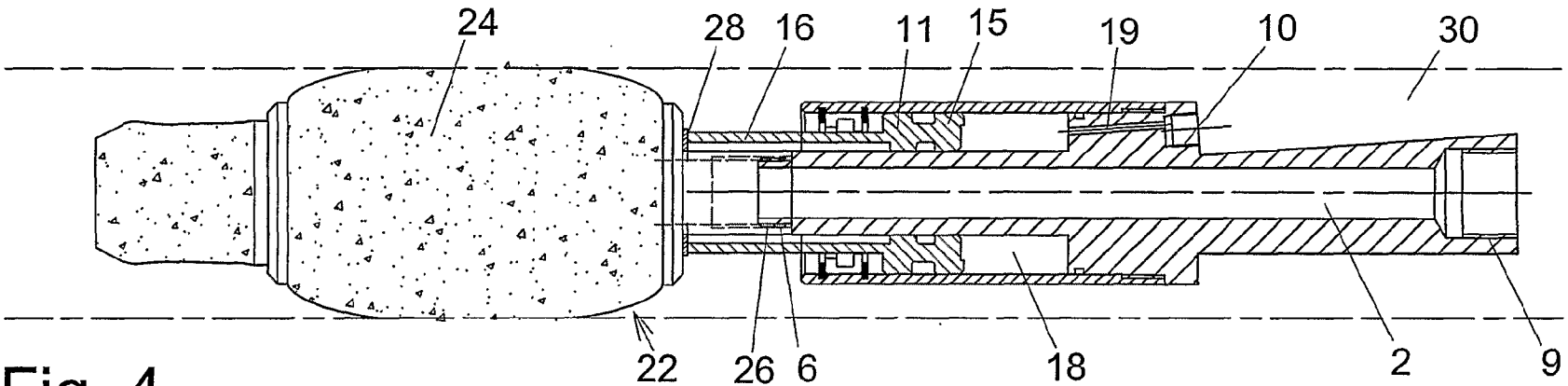
FIG. 4 is a diagrammatic side view corresponding to FIG. 3 and shows the packer in an expanded state.

FIGS. 3 and 4 illustrate an inventive arrangement connected to a packer 22 and inserted to a desired depth in a hole 30 in a rock wall. The packer is of a known kind that includes an inner tubular part 23, see FIG. 2, through which filler can be delivered through the packer and out into the hole in front of the packer. Located on the tubular part is a flexible sleeve or cuff 24, made of rubber for instance. The packer can be coupled to the fastening device with the aid of threaded parts 26 and 6 respectively. The cuff 24, however, remains movable on the tubular part 23. When hydraulic fluid or compressed air is delivered to the arrangement via the pressure connection 10 and the channel 19 the piston 11 will be subjected to a force that causes it to move forwards in an inward direction relative to the hole 30. The inner end of the front part 16 of the piston will then move out of the cylinder 12 and come into abutment with the cuff 22 and exert a compressive force on the cuff. The cuff is displaced along the tubular part 23 and is therewith compressed, wherein the cuff expands radially outwards into contact with the wall of the hole 30 at the same time. Contact with the wall of the hole results in the formation of a sealed section and the packer 22, with appendant elements, is locked firmly to the wall by means of friction. The illustrated packer 22 also includes a so-called locking washer 28, which also functions as a support for the front end surface of the piston. When the sealing cuff has been pressurized sufficiently the cylinder pressure can be lightened, wherewith the packer is held affixed in the hole by virtue of the locking washer 28 preventing rearward movement of the cuff. The infeed/injection of filler/sealant can now commence through the bit casing (or the high pressure hose), the fastening device and the packer, functioning as normal. Upon completion of the infeeding phase, the fastening device is released from the packer, and the fastening device and the bit casing are then removed from the hole while leaving the packer behind in the hole. The fastening device is used again for inserting and affixing a new packer.

According to an alternative use that has many benefits there can be used a packer that lacks a locking washer or with which the washer has been removed. In order to ensure that such a packer will be retained in the hole while exerting a sealing effect, it is necessary to keep the piston 11 under pressure until the delivered filler has hardened, at least sufficiently to ensure that it will not run out of the hole when the packer is removed. When this has been achieved, the pressure can be relieved so that the packer will return to its non-expanded state and the cuff 24 will no longer be in abutment with the wall of the hole 30. The packer can then be removed from the hole together with the affixing device and the bit casing and then re-used either in the same hole in the case of "stage grouting" or in another hole. Grouting can be injected into a deep hole in stages, from the bottom of the hole and at predetermined levels.

Figure 5:
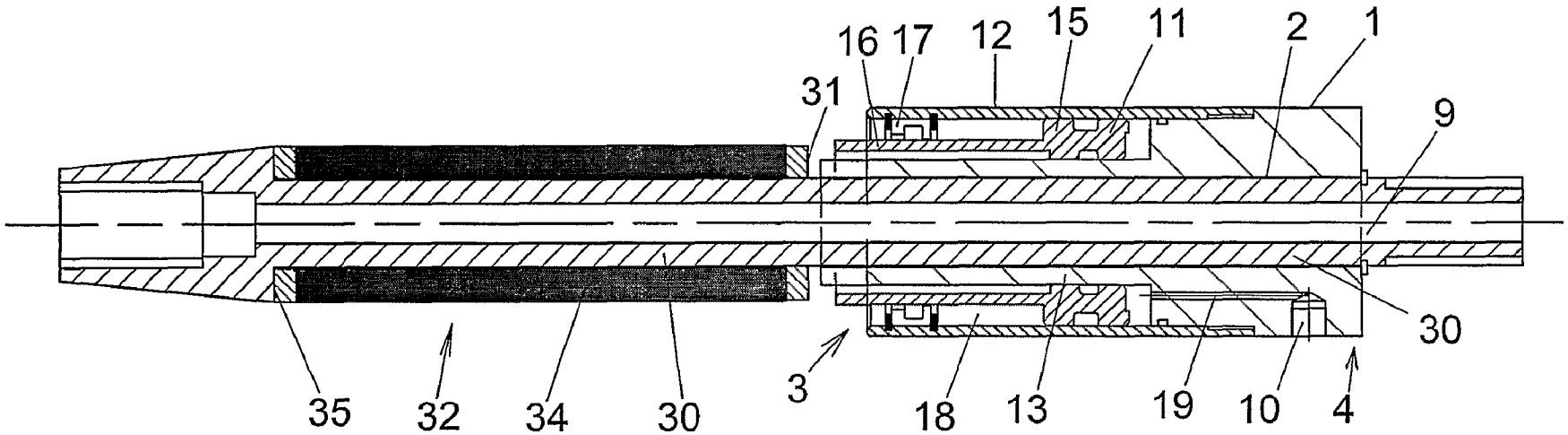
FIG. 5 is a diagrammatic sectioned side view of a second embodiment of an arrangement according to the present invention.

The embodiment of the inventive arrangement shown in FIG. 5 includes the same fundamental components as the first embodiment shown in FIG. 1. The arrangement includes an elongate main body 1 through which there extends a through-passing aperture 2. The main body has a front end 3, which faces in towards the hole in use, for affixing a packer 32 in the hole, and an opposite rear end 4. The rear end 4 of the main body 1 carries means for connection to means for supplying filler or sealant. The nature of these connecting means has already been discussed in connection with FIG. 1, although it will be understood that other types of connecting means are conceivable. The figure shows that the arrangement is connected to a supply means through the medium of a tubular part 30, as will be described hereinafter.

The main body 1 also includes pressure connecting means 10 for connection to a pressure medium source in a manner corresponding to that already described with reference to FIG. 1.

The front part of the main body 1 also includes a narrower part that functions as a piston rod 13 for the piston 11. Mounted on the main body 1 is a sleeve-like part 12 which forms the cylinder 12 of the piston-cylinder device 11, 12. The piston 11 is movable in the space between the cylinder 12 and the piston rod 13. The rear part 15 of the piston is in immediate sealing abutment with the inside of the cylinder and the outside of the piston rod. The front part 16 of the piston is much thinner in section and between the piston and the front part of the cylinder there is provided a piston guide 17 together with a seal. In other respects, the front end of the space 18 between the cylinder and the piston rod and facing inwardly of the hole is open so as to enable the front part 15 of the piston to move out of the cylinder and actuate the expandable part of the packer 32 when pressure medium is allowed to act on the rear side of the piston. As the piston moves forward, the piston guide 17 will act to stop movement of the piston and limit its length of stroke, by virtue of the rear part 15 of the piston coming into contact with the guide. Finally, the rear part of the space 18 includes in the main body a channel 19 that connects the space through the pressure connection means 10 and thus also to the pressure medium source.

This second embodiment of the arrangement is designed so that a tubular part 30 can be inserted in the through-penetrating aperture 2 in the main body 1. This tubular part constitutes an extension of a tubular part seated within the packer 32 and normally used to deliver filler to the front end of the packer. In turn, the packer is seated firmly on the tubular part 30. The device for affixing the packer is designed so that the tubular part, with the packer 32, is rotatable in the through-penetrating aperture 2. This is achieved by providing the arrangement with appropriate bearings and bushes. The arrangement is thus not affixed to the packer but is, nevertheless, fixed in relation to the same in an axial direction through the medium of the tubular part 30, which functions as a shaft. As the packer 32 expands, the front part 16 of the piston is moved forwards out of the cylinder 12 and towards the rearmost part 31 of the packer, with the aid of supplied pressure medium, so that the flexible cuff 34 of the piston will be compressed on the tubular part 30 against an abutment 35, wherewith the packer expands. When the packer has been affixed in position in the hole by means of friction resulting from said expansion, a suitable filler can be delivered through the tubular part 30 and up to the front part of the packer, for further transportation out in the surrounding hole.

It will be understood that the invention is not limited to the illustrated and described exemplifying embodiments thereof and that modifications and changes apparent to the person skilled in this art are conceivable within the scope of the accompanying claims.

The invention claimed is:

1. An arrangement for affixing an expandable packer in a hole, wherein the arrangement includes a piston-cylinder device in which the piston can be caused to move in the cylinder with the aid of a pressurized medium and in which expansion of the packer is achieved with the aid of movement of the piston by transferring force from the movement of the piston to an expandable part of the packer so as to cause the packer to expand, wherein expansion of the packer results in the packer being affixed in the hole by means of friction, characterized in that the arrangement includes an elongate main body that has a through-penetrating aperture in the longitudinal direction of said body, wherein the main body has a front end which faces inwardly of the hole when affixing the packer and faces towards the packer, and a rear end of which faces outwardly from the hole; in that at least a part of the main body has the form of a piston rod on which and along which the piston can move; and in that the arrangement includes pressure connecting means for connection to said pressurized medium, and a connection means between said pressure connection means and said piston.

2. An arrangement according to claim 1, characterized in that the arrangement includes means for connection to a filler supply means wherein filler is delivered to the hole via said through-penetrating aperture and via said packer, subsequent to having affixed the packer in the hole.

3. An arrangement according to claim 1, characterized in that the arrangement has the form of a separate unit that can be dismantled from the packer subsequent to having terminated a supply of filler to the hole.

4. An arrangement according to claim 1, characterized in that the cylinder includes a separate part mounted at least partially on the main body.

5. An arrangement according to claim 1, characterized in that the piston is provided with a return spring which ensures that the piston will return to its starting position when no longer influenced by pressurized medium.

6. An arrangement according to claim 1, characterized in that the arrangement has outer measurements which are selected to ensure that it can be inserted fully into said holes.

7. An arrangement according to claim 1, characterized in that the front end of the main body includes means for connecting the main body to the packer.

8. An arrangement according to claim 7, characterized in that the connection means of the main body for connecting said body to the packer includes a threaded part disposed as an outwardly projecting part around the aperture.

9. An arrangement according to claim 8, characterized in that the threaded part of said connection means has a left-hand thread.

10. An arrangement according to claim 7, characterized in that the connection means of the main body for connection to the packer includes a bayonet coupling disposed as an outwardly projecting part around the aperture.

11. An arrangement according to claim 1, characterized in that the rear end of the main body includes means for connection to a drill casing.

12. An arrangement according to claim 1, characterized in that the arrangement is designed for mounting on an extension of an inner tubular part of the packer, wherein said tubular part can be used to deliver filler and wherein said extension is accommodated within the through-penetrating aperture in the main body.

13. An arrangement according to claim 12, characterized in that the arrangement is such as to allow said extension of an inner tubular part of the packer to rotate within the through-penetrating aperture.

* * * * *